US008418363B2

(12) United States Patent
Patel

(10) Patent No.: US 8,418,363 B2
(45) Date of Patent: Apr. 16, 2013

(54) THREADED ROD PLUNGER INSTALLATION TOOL

(75) Inventor: Pankaj Patel, Keller, TX (US)

(73) Assignee: S.P.M. Flow Control, Inc., Fort Worth, TX (US)

( * ) Notice: Subject to any disclaimer, the term of this patent is extended or adjusted under 35 U.S.C. 154(b) by 313 days.

(21) Appl. No.: 12/835,496

(22) Filed: Jul. 13, 2010
(Under 37 CFR 1.47)

(65) Prior Publication Data

US 2011/0162187 A1 Jul. 7, 2011

Related U.S. Application Data

(60) Provisional application No. 61/225,142, filed on Jul. 13, 2009.

(51) Int. Cl.
*B23P 15/00* (2006.01)

(52) U.S. Cl.
USPC ..... 29/888.02; 29/888.01; 29/256; 29/266; 29/280; 29/428; 29/700; 29/888; 81/176.15

(58) Field of Classification Search ..... 29/428, 29/700, 888, 888.01, 888.02, 256, 266, 280; 81/176.15
See application file for complete search history.

(56) References Cited

U.S. PATENT DOCUMENTS

| | | | | |
|---|---|---|---|---|
| 3,037,460 | A * | 6/1962 | Guest et al. | 92/171.1 |
| 3,666,382 | A * | 5/1972 | Rasmussen | 17/533 |
| 3,786,551 | A * | 1/1974 | Gregg et al. | 29/266 |
| 4,009,515 | A * | 3/1977 | Racin | 29/265 |
| 4,589,180 | A * | 5/1986 | Vachon | 29/263 |
| 5,003,681 | A * | 4/1991 | Schley | 29/239 |
| 5,018,261 | A * | 5/1991 | Markous | 29/239 |
| 6,195,863 | B1 * | 3/2001 | Blake | 29/239 |
| 6,574,846 | B1 * | 6/2003 | Kang | 29/239 |
| 6,755,099 | B2 * | 6/2004 | Huang | 81/176.1 |
| 7,194,948 | B2 * | 3/2007 | Liu | 91/454 |
| 7,389,579 | B2 * | 6/2008 | Rode | 29/724 |
| 7,748,095 | B1 * | 7/2010 | Phane | 29/239 |
| 2004/0170507 | A1 | 9/2004 | Vicars | |
| 2004/0255445 | A1 * | 12/2004 | Ploeger et al. | 29/239 |
| 2005/0201881 | A1 | 9/2005 | Jensen et al. | |
| 2010/0143163 | A1 * | 6/2010 | Patel et al. | 417/313 |

FOREIGN PATENT DOCUMENTS

| | | | |
|---|---|---|---|
| JP | 07113426 | B2 | 12/1995 |
| KR | 100383826 | B1 | 5/2003 |

OTHER PUBLICATIONS

International Search Report dated Feb. 1, 2011, issued in co-pending application PCT/US2010/041832 (3 pages).

* cited by examiner

*Primary Examiner* — Richard Chang
(74) *Attorney, Agent, or Firm* — Bracewell & Giuliani LLP

(57) ABSTRACT

A plunger installation tool that exerts a force on a plunger for a reciprocating pump to install the plunger into a pump cylinder opening. Maintenance of the pump typically includes repacking of the packing that surrounds the plunger and revalving of the pump's inlet and outlet valve. To allow repacking or revalving, the pump is disassembled and the plunger is removed. The plunger installation tool threads onto the pump cylinder opening to provide a reaction point for a threaded rod that is driven at one end by a driver and engages the plunger at an opposite end during installation to push the plunger into the cylinder opening without the use of hammers by personnel.

19 Claims, 4 Drawing Sheets

THREADED ROD PLUNGER INSTALLATION TOOL

CROSS-REFERENCE TO RELATED APPLICATION

This application claims priority to provisional application 61/225,142, filed Jul. 13, 2009.

FIELD OF THE INVENTION

This invention relates in general to plungers used in reciprocating pumps, and, in particular, to a threaded rod tool for installing a plunger.

BACKGROUND OF THE INVENTION

Various kinds of pumps can be used in oilfield operations. One type of pump, for example, is a reciprocating pump. The reciprocating pump can be used to pump fluid such as chemicals, cement, or other media into a well. Reciprocating pumps typically increase the pressure within a cylinder by reciprocating a plunger longitudinally within the cylinder. Packing is generally used around the plunger and the plunger reciprocates as a crankshaft located within the pump rotates. As the plunger moves away from the cylinder, the pressure of the fluid inside chamber decreases creating a differential pressure across an inlet valve that allows the fluid to enter the cylinder. As plunger moves longitudinally towards the cylinder, the pressure of the fluid inside of the cylinder increases until the differential pressure across an outlet valve opens the outlet valve and allows fluid to exit cylinder.

Maintenance of the pump, typically includes repacking of the packing surrounding the plunger and revalving of the inlet and outlet valves mentioned above. To allow repacking or revalving, the pump is disassembled by removing a suction cover plate and removing the plunger, which can be quite heavy. Additional pump components, such as connecting rods and pony rods may need to be stroked out to push out the plunger. However, during assembly of the pump, the plunger must be reinstalled. The plunger is heavy and requires much effort to push it back into the cylinder through the packing elements. Frequently, installing the plunger requires maintenance personnel to hammer the plunger into place during installation, potentially damaging pump parts or injuring personnel.

Thus, installation of the plunger into the cylinder is time consuming, labor intensive, and potentially unsafe to personnel.

Thus, a technique would be desired that makes pump maintenance and plunger installation safer, less time consuming, and less labor intensive.

SUMMARY OF THE INVENTION

In an embodiment of the present invention, a threaded rod plunger installation tool is connected to a pump after maintenance is complete. The tool includes a threaded ring that threads into a cylinder opening. The cylinder opening is covered by a suction cover plate during operation and has threads on an interior surface. The threaded ring provides a reaction point during the installation of the plunger. The tool further comprises a nut with a handle and a pair of channels that slide over a lip formed on the exterior side of the threaded ring. The nut in this embodiment is separate from the rest of the tool.

In an embodiment of the present invention, the plunger installation tool further comprises a threaded rod that engages a threaded opening on the nut. The rod has an end that can engage the plunger and also has a bolt head on the other end that can be engaged by a driver such as a wrench.

During installation of the plunger the plunger is placed at the cylinder opening and the threaded rod plunger installation tool is mounted onto the pump. A driver such as a wrench or a motorized drill can engage the bolt head and rotate it and thereby advance the threaded rod into the cylinder opening. The nut prevents the threaded rod from backing out as it pushes the plunger into the cylinder bore. The installation tool advantageously generates sufficient force, in one example at least 2000 psi, to push the plunger into place. Once the plunger is properly in place within the pump cylinder, the threaded rod can be backed out of the nut by the driver and the plunger installation tool can then be removed for storage, allowing the suction cover plate to be placed back on the cylinder opening.

The threaded rod plunger installation tool thus advantageously provides a safer way to maintain and disassemble pumps because the plunger installation tool, rather than a hammer, can be used to push the plunger back into position within the pump cylinder. This also results in a less time consuming, potentially less damaged parts, and a less labor intensive method of maintaining and disassembling the pumps as hammering of the heavy plunger is eliminated.

DETAILED DESCRIPTION OF THE INVENTION

Figure 1:
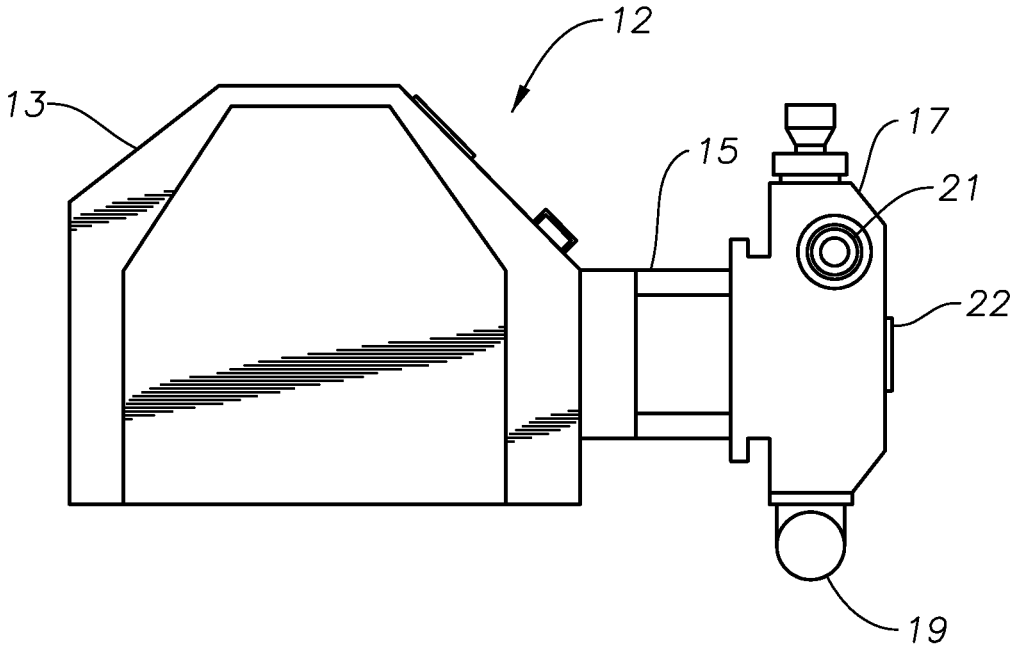
Fig. 1 (Prior Art)
FIG. 1 is a schematic side view of a prior art reciprocating pump.
Figure 2:
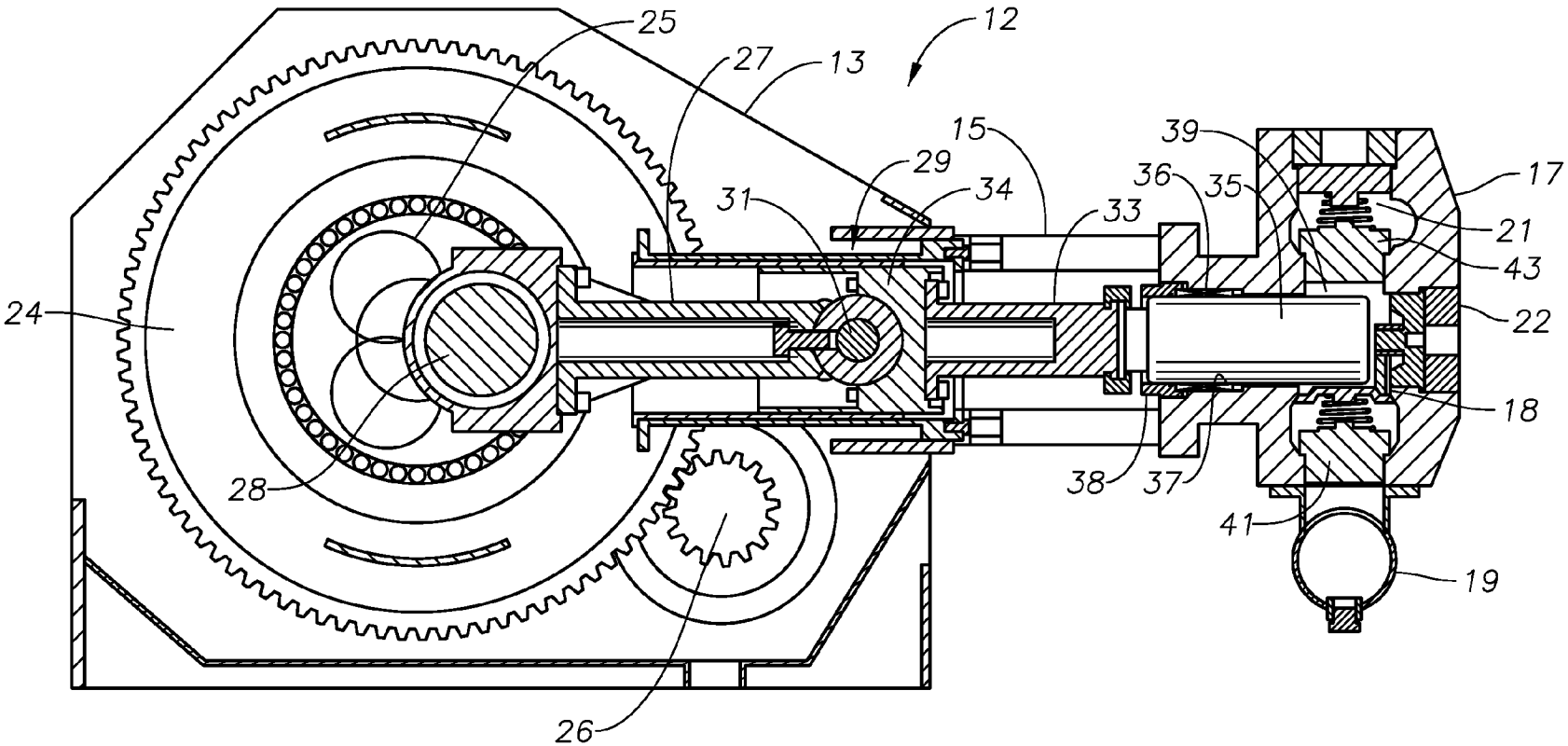
Fig. 2 (Prior Art)
FIG. 2 is a sectional view of the pump of FIG. 1.

Referring to FIGS. 1 and 2, reciprocating pump assembly or pump 12 includes a crankshaft housing 13 that comprises a majority of the outer surface of reciprocating pump 12. Stay rods 15 connect crankshaft housing 13 to a cylinder housing 17 having a set of cylinders 37 (FIG. 2). Each cylinder 37 is in communication with a fluid inlet 19 and a fluid outlet 21. As shown in FIG. 2, a suction cover plate 22 connects to an end of each cylinder 17 opposite the housing that houses the stay rods 15. Pump 12 can be free-standing on the ground, can be mounted to a trailer that can be towed between operational sites, or mounted to a skid such as for offshore operations.

Referring to FIG. 2, a portion of reciprocating pump 12 housed within crankshaft housing 13 is shown. Crankshaft housing 13 houses a crankshaft 25, which is typically mechanically connected to a motor (not shown). The motor rotates crankshaft 25 in order to drive reciprocating pump 12 (FIG. 1). In one embodiment, crankshaft 25 is cammed so that fluid is pumped from each cylinder 37 at alternating times. As is readily appreciable by those skilled in the art, alternating the cycles of pumping fluid from each of cylinders 37 helps minimize the primary, secondary, and tertiary (et al.) forces associated with reciprocating pump 12 (FIG. 1).

A gear 24 is mechanically connected to crankshaft 25, that is rotated by the motor through gears 26 and 24. A connector rod 27 is connected to the crankshaft 25 at one end. The connector rod 27 connects to a crosshead 29 through a crosshead wrist pin 31, which holds connector rod 27 longitudinally relative to crosshead 29. The connector rod 27 pivots within a crosshead bushing 34 as crankshaft 25 rotates with the other end of connector rod 27. A pony rod 33 extends from crosshead 29 in a longitudinally opposite direction from crankshaft 25. Connector rod 27 and crosshead 29 convert rotational movement of crankshaft 25 into longitudinal movement of pony rod 33.

A plunger 35 is connected to pony rod 33 for pumping the fluid passing through cylinder 37. Packing 36 surrounds plunger 35. A packing nut 38 is threaded into the cylinder housing 17, and acts to maintain the packing 36 in the proper position within cylinder 37. Cylinder 37 includes an interior or cylinder chamber 39, which is where plunger 35 compresses the fluid being pumped by reciprocating pump 12 (FIG. 1). Cylinder 37 also typically includes an inlet valve 41 and an outlet valve 43. Valves 41 and 43 are usually spring-loaded valves and are actuated by a predetermined differential pressure. Inlet valve 41 actuates to control fluid flow through fluid inlet 19 into cylinder chamber 39, and outlet valve 43 actuates to control fluid flow through fluid outlet 21 from cylinder chamber 39.

Plunger 35 reciprocates, or moves longitudinally toward and away from cylinder chamber 39, as crankshaft 25 rotates. As plunger 35 moves longitudinally away from cylinder chamber 39, the pressure of the fluid inside chamber 39 decreases creating a differential pressure across inlet valve 41, which actuates valve 41 and allows the fluid to enter cylinder chamber 39 from fluid inlet 19. The fluid being pumped enters cylinder chamber 39 as plunger 35 continues to move longitudinally away from cylinder chamber 39 until the pressure difference between the fluid inside chamber 39 and the fluid in fluid inlet 19 is small enough for inlet valve 41 to actuate to its closed position. As plunger 35 begins to move longitudinally towards cylinder chamber 39, the pressure on the fluid inside of cylinder chamber 39 begins to increase. Fluid pressure inside cylinder chamber 39 continues to increase as plunger 35 approaches cylinder chamber 39 until the differential pressure across outlet valve 43 is large enough to actuate valve 43 and allow the fluid to exit cylinder 37 through fluid outlet 21. In one embodiment, fluid is only pumped across one side of plunger 35, therefore reciprocating pump 12 is a single-acting reciprocating pump.

Maintenance of the pump 12, typically includes repacking of the packing 36 surrounding the plunger 35 and revalving of the inlet and outlet valves 41, 43. To allow repacking or revalving, the pump 12 is disassembled by removing the suction cover plate 22 and removing the plunger 35. The connector rod 27 and pony rod 33 can be stroked out to slide the plunger 35 out and provide access to the packing 36 and valves 41, 43. Frequently, installing the plunger 35 requires maintenance personnel to hammer the plunger 35 into place during installation. This approach to reinstall the plunger 35 can damage pump 12 parts and injure personnel.

Figure 3:
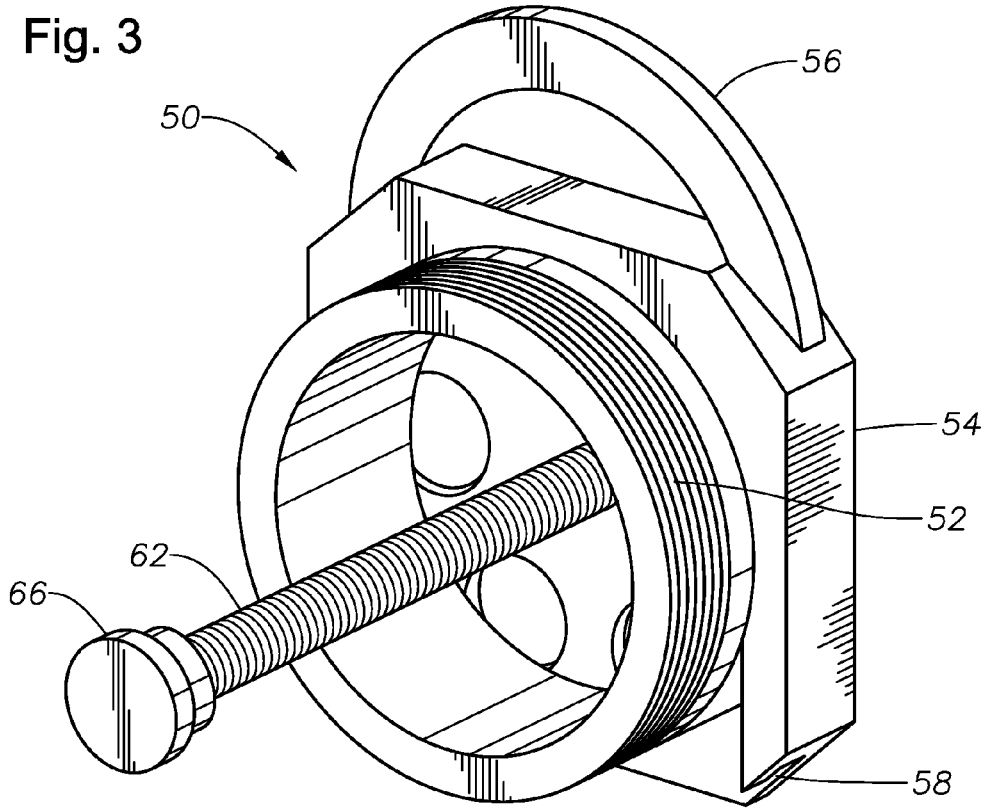
FIG. 3 is an enlarged perspective view of the interior side of one embodiment of a threaded rod installation tool used to install the plunger back into the cylinder opening, constructed in accordance with the invention.
Figure 4:
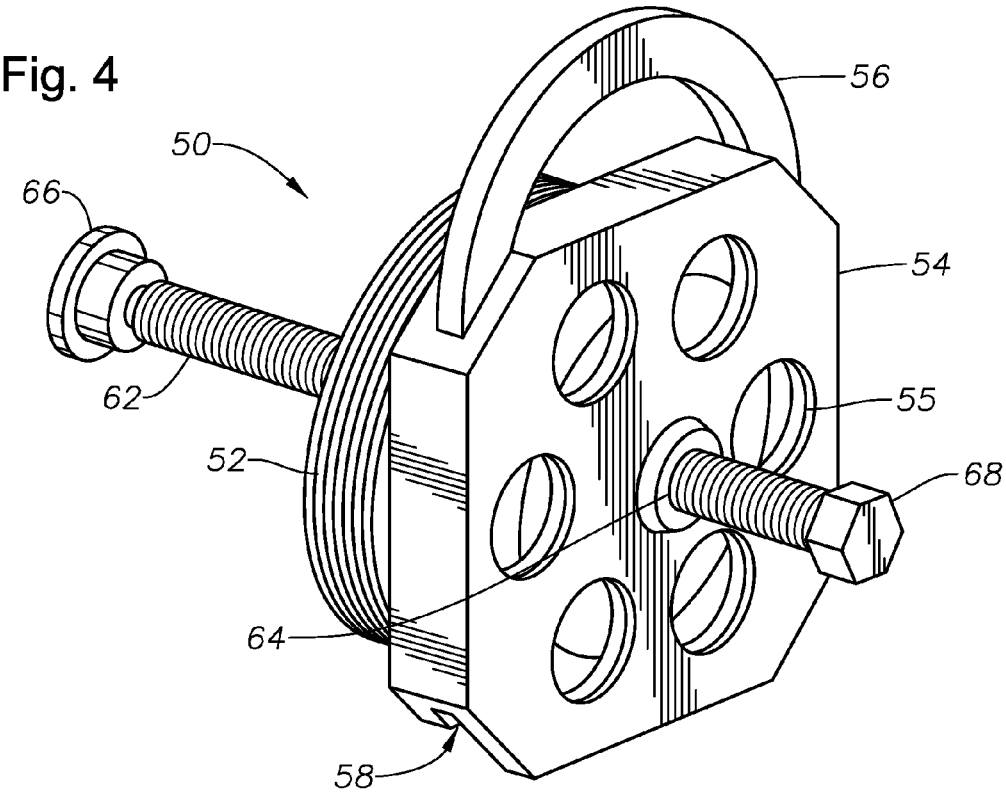
FIG. 4 is an enlarged perspective view of the exterior side of one embodiment of a threaded rod installation tool used to install the plunger back into the cylinder opening, constructed in accordance with the invention.
Figure 5:
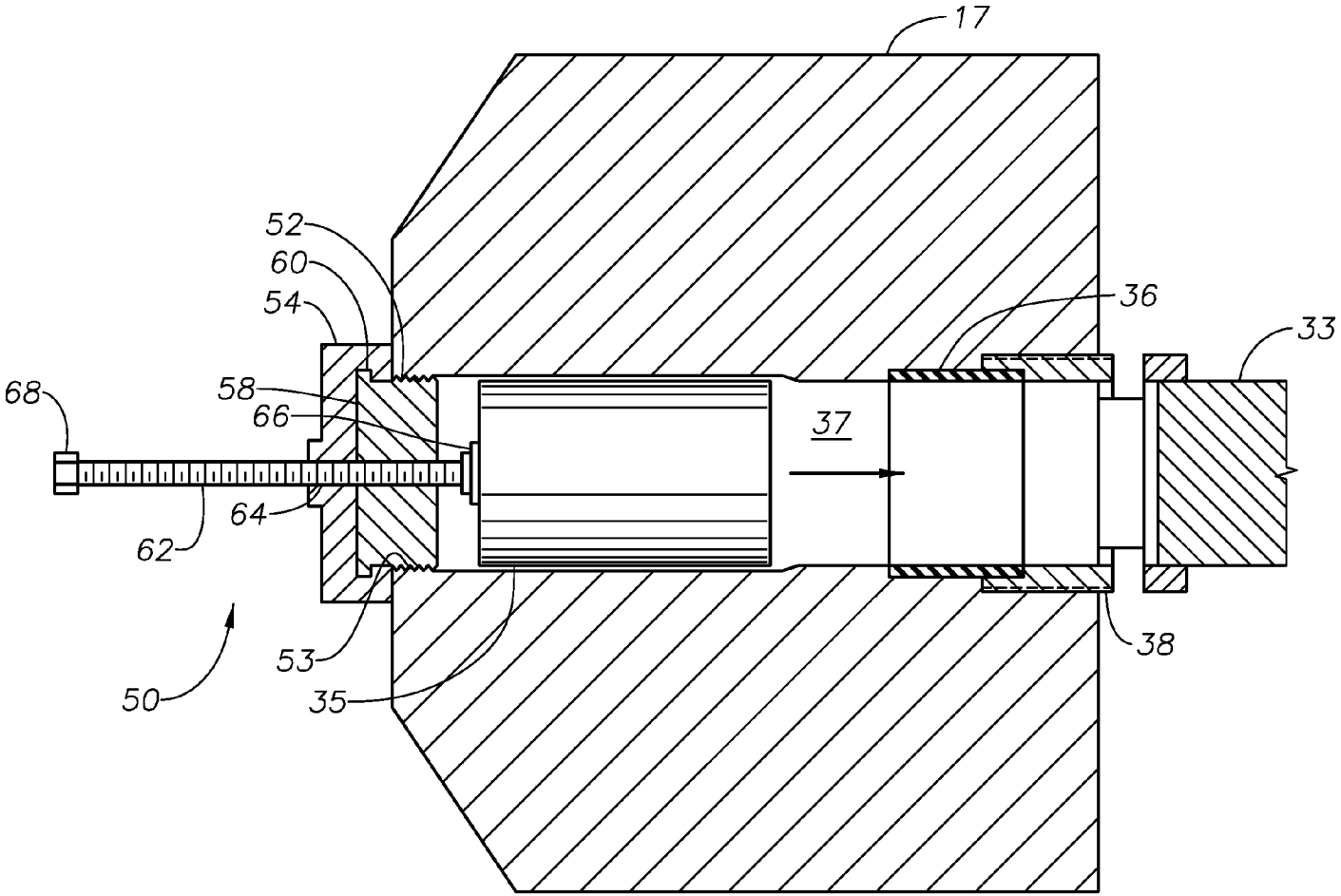
FIG. 5 is a sectional view of one embodiment of a threaded rod installation tool pushing the plunger back into the cylinder opening, constructed in accordance with the invention.

Referring to FIGS. 3-5, an embodiment of a threaded rod plunger installation tool 50 is shown. The threaded rod plunger installation tool 50 can be placed proximate to the pump 12 after maintenance is complete. The tool 50 comprises a threaded ring 52 shown threaded on an outer circumference that screws into a threaded pump cylinder opening 53 (FIG. 5). The tool 50 thus provides a reaction point during installation of the plunger 35. The tool 50 further includes a planar shaped nut 54 with an attached curved handle 56. The nut 54 lies in a plane that is substantially perpendicular to an axis of the ring 52. A pair of side channels 58 is formed in an end of the nut 54 opposite where the handle 56 is mounted. The nut 54 can be held by the handle 56 and slid over a lip 60 (FIG. 5) formed on the exterior side of the threaded ring 52. The channels 58 on the nut 54 slidingly receives the lip 60 on the threaded ring 52. The nut 54 can be solid or can have a plurality of holes 55 to reduce the weight of the nut 54. Further comprising the plunger installation tool 50 is a threaded rod 62 that engages a threaded opening 64 on the nut 54. The threaded rod 62 has a plunger engagement end 66 and a bolt head 68 on the other end for engagement with a driver such as a wrench.

During installation of the plunger 35, as shown in FIG. 5, the plunger 35 is placed at the cylinder opening 53 and the threaded rod plunger installation tool 50 is mounted onto the threaded cylinder opening 53 with the threaded ring 52 portion. A driver such as a wrench or a motorized drill can engage the bolt head 68 to rotate it and thereby advance the threaded rod 62 into the cylinder opening 53. The nut 54 prevents the threaded rod 62 from backing out. When the plunger engagement end 66 engages one end of the plunger 35, the continued advancement of the threaded rod 62 in response to its rotation by the driver will force the plunger 35 into the bore 37 of the pump cylinder 17. The installation tool 50 can generate sufficient distributed force, preferably at least 2000 psi, through the driver and reaction points created by the threaded ring 52 and nut 54, to push the plunger 35 into place. After the plunger 35 is properly in place within the pump cylinder 17, the threaded rod 62 can be backed out of the nut 54 by the driver. The plunger installation tool 50 can then be removed for storage and the suction cover plate 22 placed back on the cylinder opening 53.

In another embodiment (not shown), the threaded rod plunger installation tool 50 has a hole at one end through which a rod can pass through and act as the driver rather than a wrench.

Reciprocating pumps 12 are large, and complex pieces of equipment with many parts that may have to be replaced as they wear out. Making the disassembly safer, simpler, and less time consuming is thus desirable because it makes pump maintenance safer and less labor intensive. By using a threaded rod plunger installation tool 50 that can install the plunger 35 back into the pump 12 via a mechanical wrench or power drill, the need for manually hammering the plunger 35 into place is eliminated. Thus, the dangerous and labor intensive task of installing the plunger 35 back into the pump 12 after completion of maintenance, is eliminated.

This written description uses examples to disclose the invention, including the best mode, and also enable a person of ordinary skill in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A plunger installation tool for maintenance of a reciprocating pump, comprising:

a circular mating end adapted to engage a cylinder opening on the pump, a flange that projects axially outward from the mating end and past the cylinder opening;

a nut that mates with the flange and having a threaded opening along a central axis, an interior side of the nut in threadingly contact with a housing of the pump; and a threaded rod that threadingly engages the threaded opening of the nut, the threaded rod having a bolt end that projects outward from the cylinder opening so that a driver can engage the bolt end during operation of the installation tool, the threaded rod having an engagement end that projects inward into the cylinder opening to engage the plunger and push the plunger into the cylinder opening when the threaded rod is advanced into the cylinder opening.

2. The installation tool of claim 1, wherein the bolt end of the threaded rod is adapted to be driven by a wrench that engages the bolt end.

3. The installation tool of claim 1, wherein the bolt end of the threaded rod is adapted to be driven by a drill that engages the bolt end.

4. The installation tool of claim 1, wherein the flange has a lip having an outer diameter larger than the cylinder opening.

5. The installation tool of claim 4, wherein the nut has a pair of channels formed within that receive the lip of the flange when the nut is placed over the lip of the flange.

6. The installation tool of claim 1, further comprising a handle formed on the nut.

7. The installation tool of claim 1, wherein the mating end has threads on an exterior surface for threadingly engaging corresponding threads on an interior cylindrical surface of the cylinder opening.

8. The installation tool of claim 1, wherein the nut has a plurality of openings disposed about the central axis equidistant from each other.

9. The installation tool of claim 1, wherein the threaded rod has a length approximately equal to a length of the cylinder opening.

10. The installation tool of claim 1, wherein engagement end of the threaded rod has a larger diameter than a threaded portion of the threaded rod.

11. A plunger installation tool for maintenance of a pump, comprising:

a circular mating end adapted to engage a cylinder opening on the pump, the mating end having a threaded outer diameter for threadingly engaging corresponding threads on an interior surface of the cylinder opening;

a flange that projects axially outward from the mating end and past the cylinder opening, the flange having a lip with an outer diameter larger than an outer diameter of the cylinder opening;

a nut having a pair of channels formed within for receiving the lip of the flange and having a threaded opening along a central axis, an interior side of the nut in contact with a housing of the pump; and a threaded rod that threadingly engages the threaded opening of the nut, the threaded rod having a bolt end that projects outward from the cylinder opening so that a driver can engage the bolt end during operation of the installation tool, the threaded rod having an engagement end that projects inward into the cylinder opening to engage the plunger and push the plunger into the cylinder opening when the threaded rod is advanced into the cylinder opening.

12. The installation tool of claim 11, wherein the bolt end of the threaded rod is adapted to be driven by a wrench that engages the bolt end.

13. The installation tool of claim 11, wherein the bolt end of the threaded rod is adapted to be driven by a drill that engages the bolt end.

14. The installation tool of claim 11, further comprising a handle formed on the nut.

15. The installation tool of claim 11, wherein the nut has a plurality of openings disposed about the central axis equidistant from each other.

16. The installation tool of claim 11, wherein the threaded rod has a length approximately equal to a length of the cylinder opening.

17. The installation tool of claim 11, wherein engagement end of the threaded rod has a larger diameter than a threaded portion of the threaded rod.

18. A method for installing a plunger during maintenance or assembly of a pump, comprising:

placing a portion of the plunger in a cylinder opening on the pump;

providing a plunger installation tool comprising, a ring with a threaded outer circumference and a lip that projects radially outward from an end of the ring, a nut having a channel along an edge of the nut that extends into the nut from an outer surface of the nut, a threaded bore through the nut, and a threaded rod engaged in the threaded bore;

mating an end of the ring to the cylinder opening on the pump;

mating the nut onto the ring by inserting the lip into the channel;

advancing the threaded rod through the threaded bore in the nut until an engagement end of the rod engages an end of the plunger;

exerting a force on the plunger via a driver acting on the threaded rod to thereby push the plunger into a desired position within the cylinder opening;

removing the threaded rod, nut, and mating end from the cylinder opening, wherein the step of mating the ring to the cylinder opening comprises screwing a threaded end of the ring into the cylinder opening.

19. The method of claim 18, further comprising the step of repacking an area surrounding the plunger.

* * * * *